US006537147B2

(12) United States Patent
Smith

(10) Patent No.: US 6,537,147 B2
(45) Date of Patent: Mar. 25, 2003

(54) TILE ROOF RIDGE VENT

(76) Inventor: Richard D. Smith, 7342 W. Hearthstone Green, Houston, TX (US) 77095

( * ) Notice: Subject to any disclaimer, the term of this patent is extended or adjusted under 35 U.S.C. 154(b) by 13 days.

(21) Appl. No.: 10/202,815

(22) Filed: Jul. 25, 2002

(65) Prior Publication Data

US 2002/0187745 A1 Dec. 12, 2002

Related U.S. Application Data

(63) Continuation of application No. 09/721,359, filed on Nov. 22, 2000, now abandoned, which is a continuation-in-part of application No. 09/651,038, filed on Aug. 30, 2000, now abandoned.

(51) Int. Cl.[7] ..... F24F 7/02
(52) U.S. Cl. ..... 454/365; 52/199
(58) Field of Search ..... 454/365, 366, 454/367, 368; 52/199, 200

(56) References Cited

U.S. PATENT DOCUMENTS 6,128,870 A * 10/2000 Kohler ..... 52/199

FOREIGN PATENT DOCUMENTS

| | | | | |
|---|---|---|---|---|
| FR | 2585810 A | * | 2/1987 | ..... F24F/7/02 |
| GB | 2153067 A | * | 8/1985 | ..... F24F/7/02 |
| JP | 359109732 A | * | 6/1984 | ..... F24F/7/02 |

* cited by examiner

*Primary Examiner*—Derek Boles
(74) *Attorney, Agent, or Firm*—Jackie Lee Duke

(57) ABSTRACT

A tile roof ridge row vent and the method of its use and construction are disclosed. The ridge row vent is designed for use with either barrel tile or flat tile. The tile roof ridge row vent includes an elongate member having a vertical section and a side section connected to allow air flow therebetween. The vertical section has a lower sealing skirt that extends under the top row of roof tiles and the side section includes plurality of ventilation openings angled downwardly and outwardly to allow air to exit the vent while preventing rain or other inclement weather from entering the vent. A second embodiment is shown for use with a single sided or mansard type roof. A third embodiment is shown for use in high wind and hurricane prone areas with an angled roof and includes an external baffle added to the ridge row vent. A fourth embodiment utilizing the ridge row vent with the external baffle is shown for use with a mansard type roof.

20 Claims, 8 Drawing Sheets

TILE ROOF RIDGE VENT

This is a continuation of application Ser. No. 09/721,359 filed Nov. 22, 2000 now abn. which is a continuation-in-part of application Ser. No. 09/651,038 filed Aug. 30, 2000 now abn. and these prior applications are hereby incorporated herein by reference.

BACKGROUND OF THE INVENTION

1. Field of the Invention

This invention relates to a ridge row ventilation system for angled tile roofs to facilitate the exhausting of hot air from the attic space beneath the angled tile roof. The ridge row vent of the current invention is equally suitable for roof tiles with a semi-circular cross section, commonly referred to as barrel tile, or flat tiles.

Typically, tile roofs have been constructed with the tiles laid in rows called courses. Adjacent courses overlap each other to allow rain to run off the roof. Such roofs are known for their durability. The primary problem with such roofs is the venting of hot air from the attic space under the tile roof. Previous construction techniques had the last or top row terminate at the ridge row or header board so there is no ventilation slot. A curved tile or cap tile is then secured to the ridge row header board. This cap tile curves downwardly to within a few inches of the top row of roof tiles on either side of the ridge row header board. Just prior to the cap tile being nailed to the header board, the space between the edge of the cap tile and the top row of roof tiles is filled with mortar to act as a sealer to prevent rain or other inclement weather from blowing under the edge of the cap tile.

This system works reasonably well in providing a weather tight roof but leaves much to be desired in allowing venting of the hot air in the attic space under the roof. With this system, hot air cannot be vented from the attic space beneath the roof. Therefore, there exists a need for a tile roof ridge vent that is economical, easy to install and efficiently vents the hot air from the attic space under the tile roof. Additionally, such a tile roof ridge vent with an external baffle would be desirable in high wind or hurricane prone areas to ensure wind driven water does not enter the ridge vent. It is the construction and method of use of such tile roof ridge vents to which the present invention is directed.

2. Description of Related Art

U.S. Pat. No. 4,558,637 to R. E. Mason discloses a roof ridge ventilator that uses a preformed metal louver that is installed under a roof ridge. Other types of roof ridge ventilators using a preformed louver installed under a roof ridge are shown in U.S. Pat. No. 4,685,285 to C. A. Cooper and U.S. Pat. No. 4,903,445 to J. P. Mankowski.

A system using a filter in combination with a ventilator is shown in U.S. Pat. No. 5,326,318 to M. J. Rotter.

U.S. Pat. No. 5,697,842 to M. P. Donnelly discloses a ventilator system using a system of interlocking blocks to elevate the ridge row and improve ventilation.

A venturi system specifically directed to tile roofs is disclosed in U.S. Pat. No. 5,766,071 to H. G. Kirkwood.

SUMMARY OF THE INVENTION

The tile roof ridge row vent of the present invention and the method of its use and construction is designed for use with a tile roof using either barrel tile or flat tile. The tile roof ridge row vent is designed to ventilate the interior space under a tile roof to the exterior. It includes an elongate member having a vertical section and a side section. The vertical section and side section are connected to allow air flow therebetween. The vertical section has a lower sealing skirt that extends under the top row of roof tiles and the side section includes plurality of ventilation openings angled downwardly and outwardly to allow air to exit the vent while preventing rain or other inclement weather from entering the vent.

The tile roof ridge row vents are designed for use with an angled roof having a first plurality of roofing tiles arranged in overlapping courses located on one side of the angled roof and a second plurality of roofing tiles arranged in overlapping courses located on an adjacent side of an angled roof. The roof terminates in a ridge row header board disposed between the first plurality of roofing tiles and the second plurality of roofing tiles. The roofing tiles terminate just short of the ridge row to form ventilation slots adjacent the ridge row header on each side. The ridge row vents are attached to the ridge row header board with the ridge row vents disposed over the ventilation slots to facilitate air flow from the interior space under the roof to the exterior. A plurality of ridge row cap tiles are secured to the ridge row header to prevent ingress of inclement weather and a sealing mortar is applied between the ridge row vents and the roofing tiles. The ridge row vents are formed of an injection molded plastic and typically are four feet in length. Additional ridge row vents are laid end to end along the length of the ridge row to allow full venting of the hot air in the attic space under the roof.

A second embodiment is shown for use with a single sided or mansard type roof. A third embodiment is shown for use with an angled roof and includes an external baffle added to the ridge row vent. This external baffle angles upwardly and outwardly away from the ridge row vent and ensures wind driven rain will not enter the ridge row vent. It is particularly suited for high wind or hurricane prone areas. A fourth embodiment utilizing the ridge row vent with the external baffle is shown for use with a mansard type roof.

One object of the present invention is to provide a ridge row vent particularly suited for use with tile roofs that is economical and allows full venting of the attic space under the tile roof.

Another object of the present invention is to provide a ventilation system for a tile roof that works with curved or flat tiles.

A further object of the present invention is to provide a ridge row vent particularly suited for use with tile roofs that is easy to install.

A still further object of the present invention is to provide a ridge row vent with an external baffle for use in high wind or hurricane prone areas.

Other objects and advantages of the present invention are pointed out in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
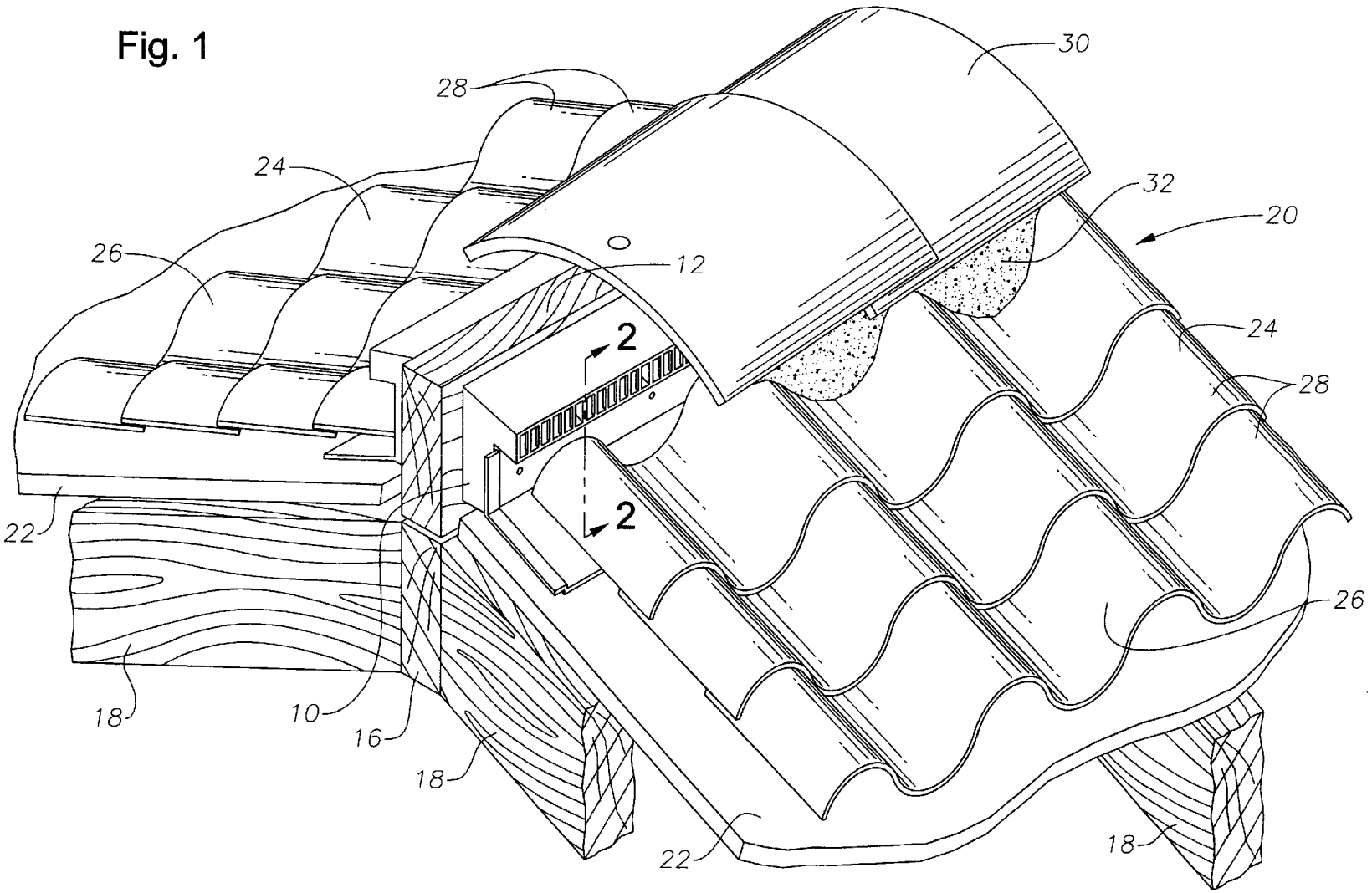
FIG. 1 is a perspective view of the tile roof ridge vent installed on a typical angled roof.

With reference to the drawings, and particularly to FIG. 1, a perspective view of a typical angled roof is shown. Ridge row vent of the present invention is denoted generally by numeral 10. Ridge row vents 10 are disposed on each side of ridge row header 12 of angled roof 14. Ridge row header 12 sits atop ridge board 16. Roof rafters 18 abut and are secured to ridge board 16 by nailing or suitable means as is well known by those of ordinary skill in the art and define the angle of the roof 20. Decking or sheathing 22 is secured to rafters 18 by suitable means as nailing. Each side 24 of roof 20 is covered by a plurality of roofing tiles 26 laid in overlapping rows or courses 28 and secured to decking or sheathing 22 by suitable means such as nailing. Although roofing tiles 26 are shown as being semicircular in cross section, tiles 26 could be flat and work equally well. Ridge row cap tiles 30 are secured to ridge row header 12 by suitable means as nailing.

Figure 2:
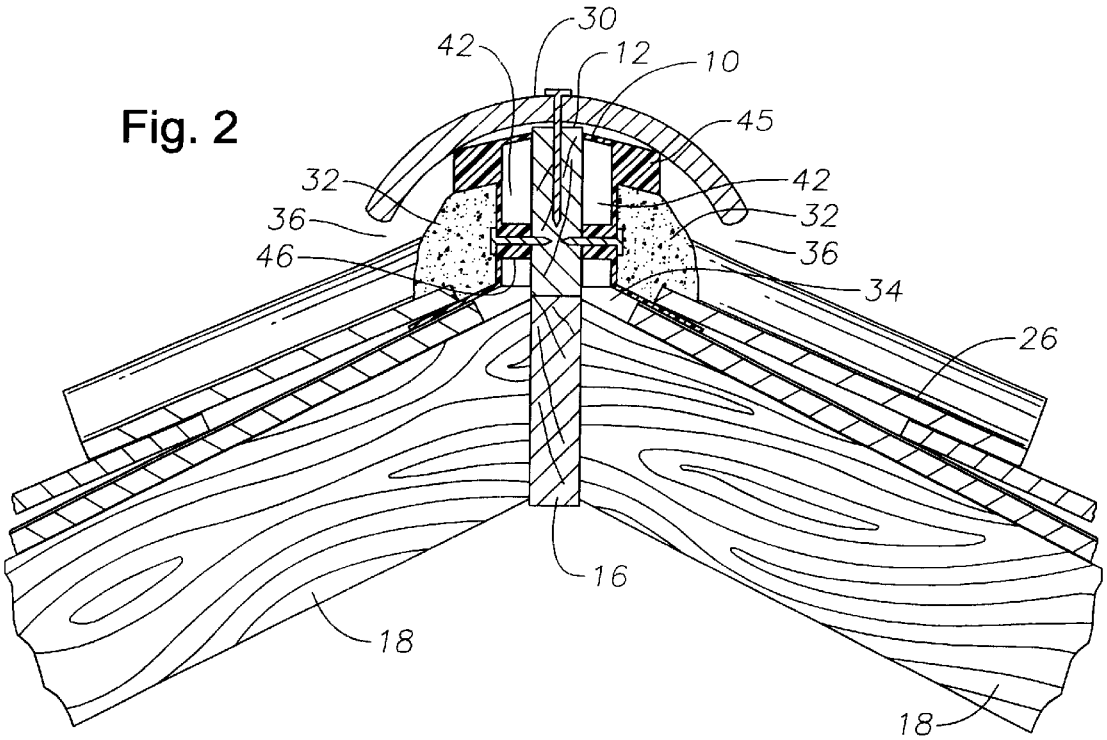
FIG. 2 is a section view of the tile roof ridge vent of FIG. 1, taken along lines 2—2.

As best seen in FIG. 2, the upper end of roofing tiles 26 are sealed to ridge row vent 10 by mortar 32. Decking or sheathing 22 terminates a short distance, typically ¾" to 1", from ridge row header 12 and ridge board 16 to form ventilation slot 34. Hot air within the attic space below roof 20 can then flow upward through ventilation slots 34 and out through ridge row vents 10. The height of ridge row header 12 and the size of ridge row cap tiles 30 are chosen so that air gap 36 is left to allow the aforementioned hot air to vent to the outside air.

Figure 3:
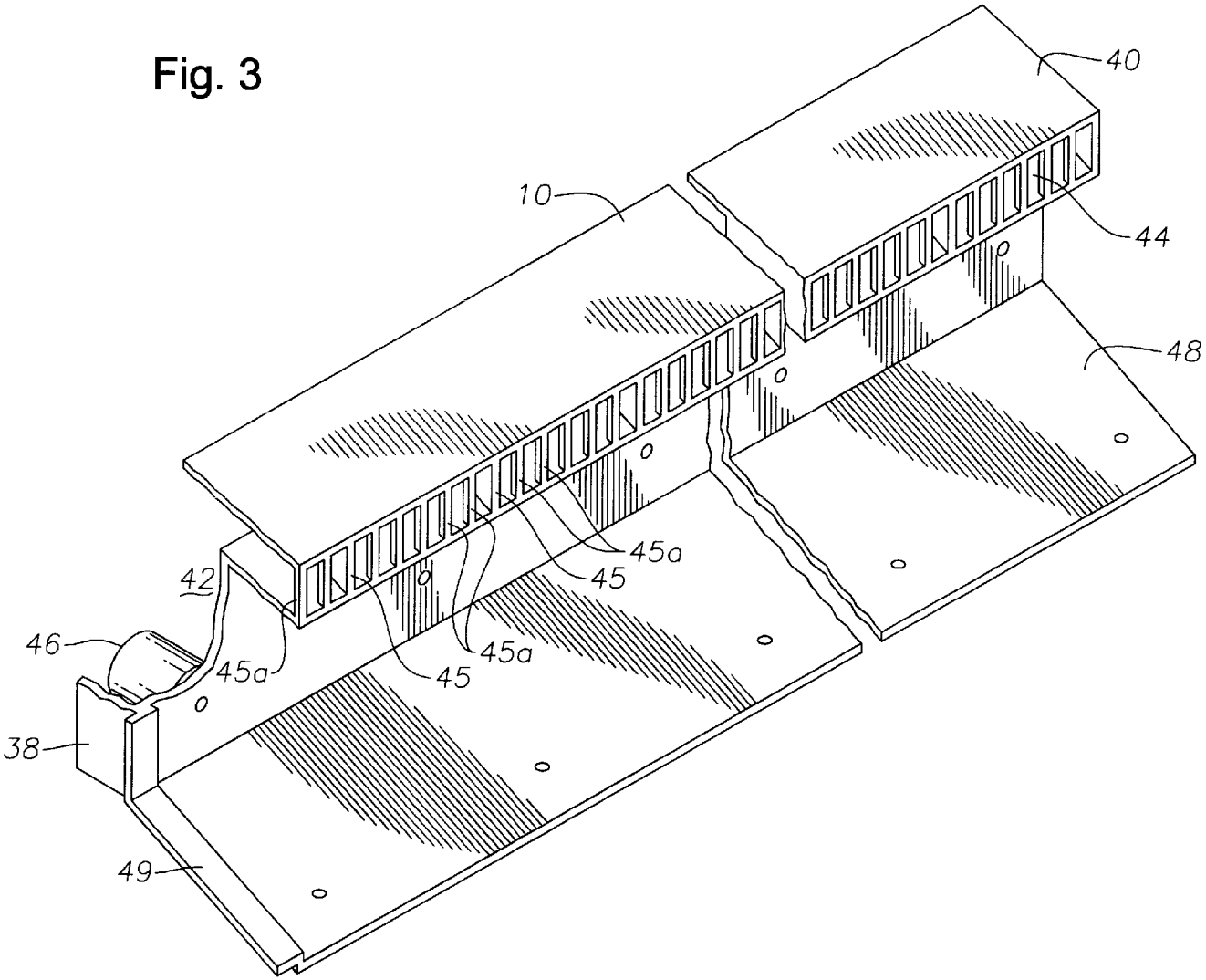
FIG. 3 is a perspective view of the tile roof ridge vent, partly in section.

Details of ridge row vent 10 are best seen in FIG. 3. Ridge row vent 10 is composed of vertical section 38 and side section 40 molded as a unitary structure of a suitable thermal set plastic. Vertical section 38 and side section 40 are connected by air channel 42 allows the free flow of air upwardly and outwardly through ventilation openings 44. Side section 40 with ventilation openings 44 is angled downwardly to minimize the ingress of weather elements such as blowing rain or snow. Primary baffle supports 45 are positioned periodically within ventilation openings 44. Positioned between primary baffle supports 45 are secondary baffles 45*a*. Secondary baffles 45*a* help to prevent the ingress of inclement weather, such as blowing rain or snow. Any inclement weather entering through secondary baffles 45*a*, is stopped by the downward slope of ventilation openings 44 and can then run back out ventilation opening 44. Vertical section 38 includes securing points or buttons 46 integrally formed on the rear of vertical section 38. Securing points or buttons 46 allow proper spacing of ridge row vent 10 with respect to ridge row header 12 and ensure air channel 42 is positioned over ventilation slots 34. Sealing skirt 48 is also integrally formed on the lower portion of vertical section 38. Sealing skirt 48 can be bent to accommodate varying roof angles. At one end of ridge row vent 10 and formed on sealing skirt 48 is lip seal 49. Lip seal 49 is designed to overlap sealing skirt 48 when ridge row vents 10 are laid end to end and prevent any leakage between adjacent ridge row vents 10. Sealing skirt 48 is nailed to decking or sheathing 22 underneath roofing tiles 26. As noted above, mortar 32 is applied between sealing skirt 48 and the upper end of roofing tiles 26 to ensure blowing rain or other inclement weather does not get underneath roofing tiles 26 to decking 22.

Figure 4:
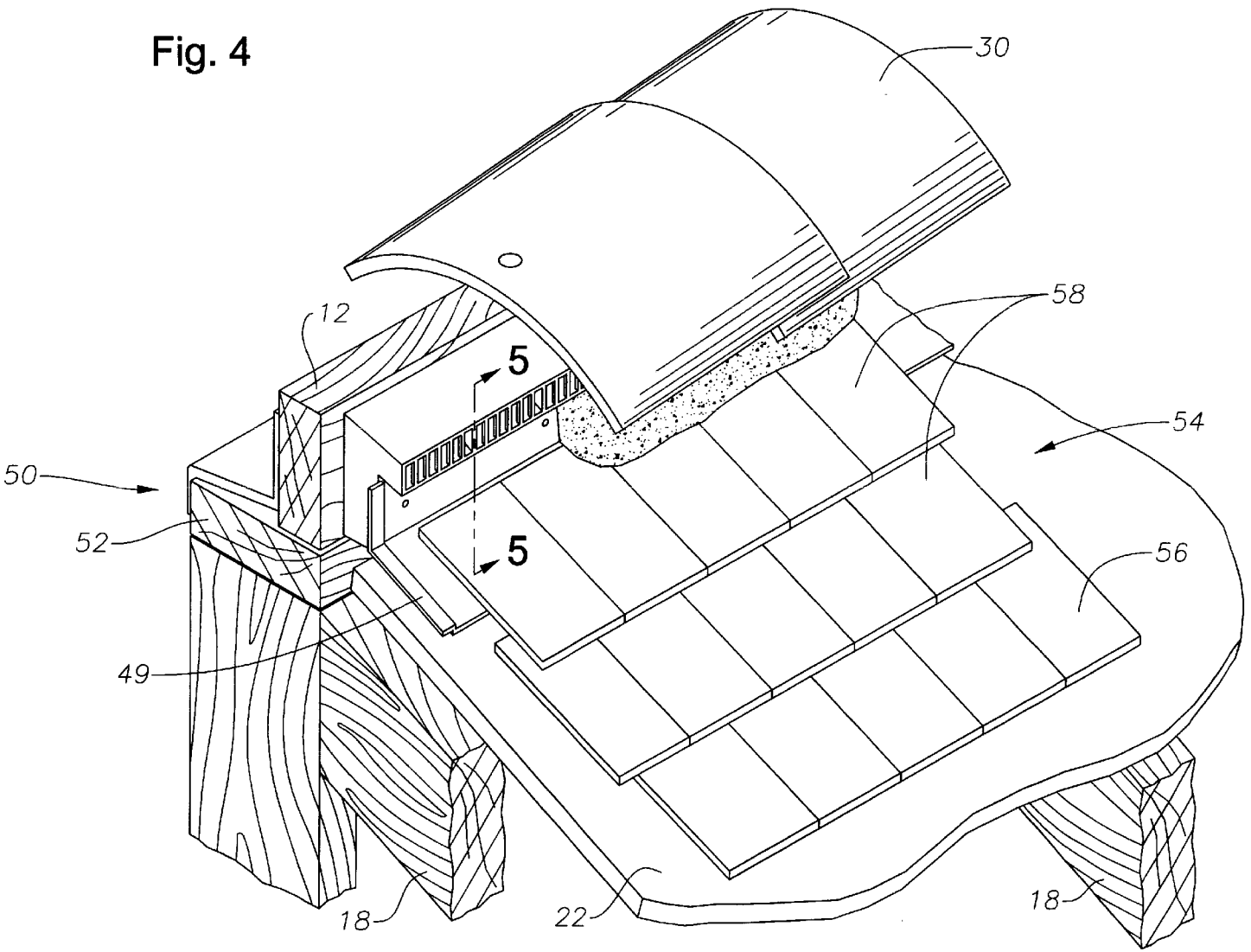
FIG. 4 is a perspective view of the tile roof ridge vent installed on a single side or mansard style roof with flat tiles.

A second embodiment showing roof ridge vent 10 in conjunction with a single sided or mansard style roof 50 is shown in FIG. 4. Those items which are the same as in the first embodiment retain their numerical designations. Ridge row vents 10 are disposed on the side of ridge row header 12 of mansard roof 50. Ridge row header 12 sits atop header board 52. Roof rafters 18 abut and are secured to header board 52 by nailing or suitable means as is well known by those of ordinary skill in the art and define the angle of mansard roof 50. Decking or sheathing 22 is secured to rafters 18 by suitable means as nailing. Side 54 of mansard roof 50 is covered by a plurality of roofing tiles 56 laid in overlapping rows or courses 58 and secured to decking or sheathing 22 by suitable means such as nailing. Although roofing tiles 56 are shown as being flat, tiles 56 could be of a semicircular cross section and work equally well. Ridge row cap tiles 30 are secured to ridge row header 12 by suitable means as nailing.

Figure 5:
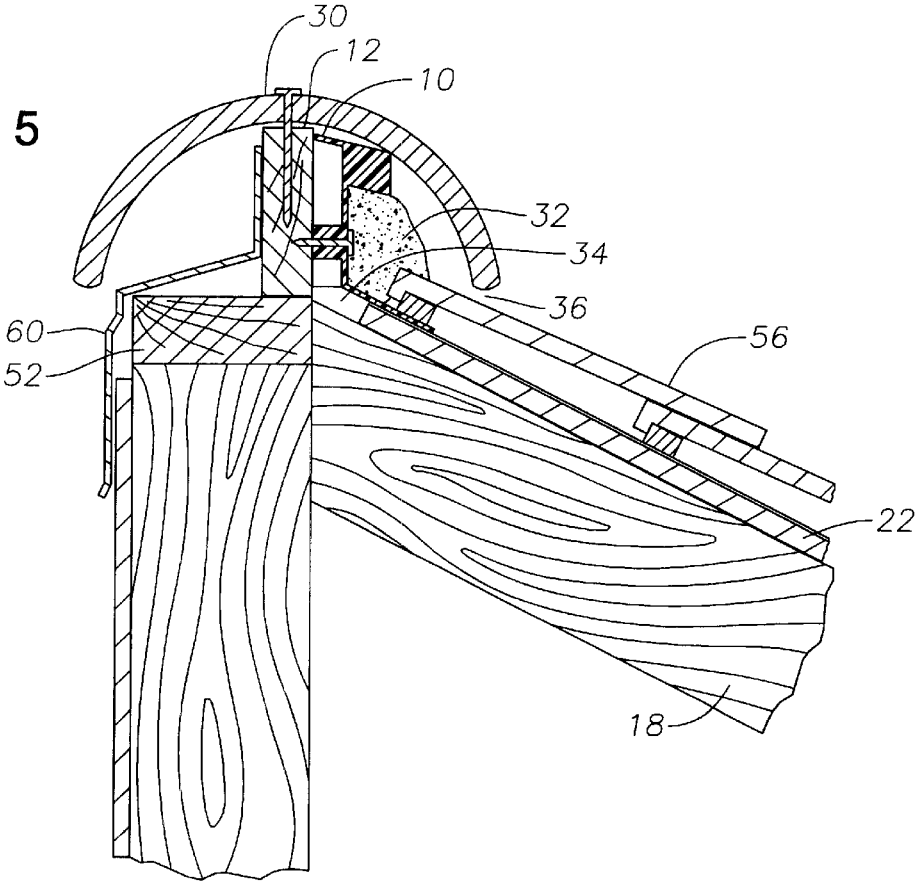
FIG. 5 is a section end view of the tile roof ridge vent of FIG. 4, taken along lines 5—5.

As best seen in FIG. 5, the upper end of roofing tiles 26 are sealed to ridge row vent 10 by mortar 32. Decking or sheathing 22 terminates a short distance, typically ¾" to 1", from ridge row header 12 and header board 52 to form ventilation slot 34. Hot air within the attic space below roof 50 can then flow upward through ventilation slot 34 and out through ridge row vents 10. The height of ridge row header 12 and the size of ridge row cap tiles 30 are chosen so that air gap 36 is left to allow the aforementioned hot air to vent to the outside air. The opposite side of roof 50 is closed off by suitable sealing means as flashing 60, well known to those of ordinary skill in the art.

Figure 6:
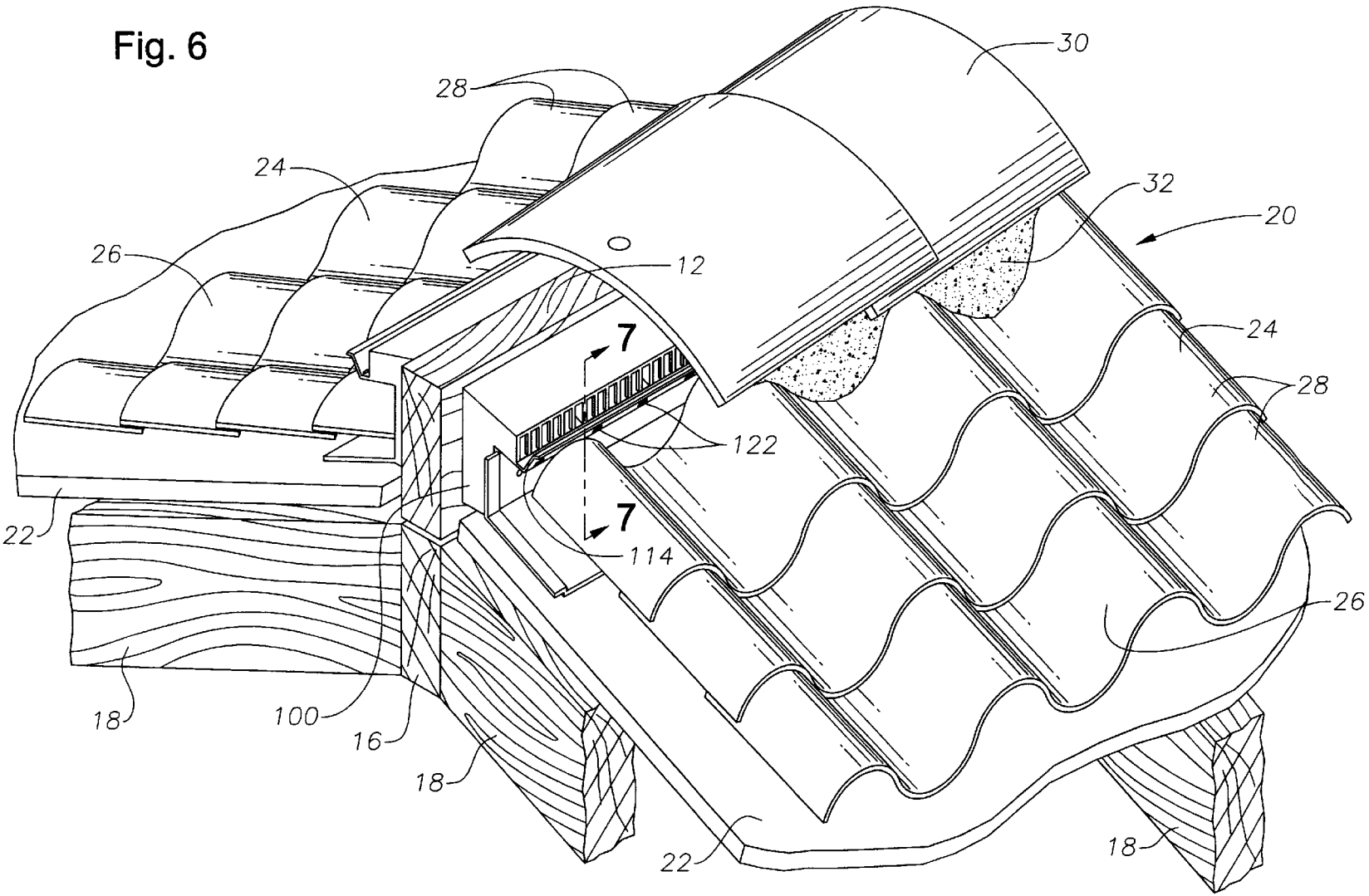
FIG. 6 is a perspective view of the tile roof ridge vent installed on a typical angled roof.

A third embodiment showing high wind area ridge row vent 100 in conjunction with a typical angled roof is shown in FIG. 6. Those items which are the same as in the previous embodiments retain their numerical designations. High wind area ridge row vents 100 are disposed on each side of ridge row header 12 of angled roof 14. Ridge row header 12 sits atop ridge board 16. Roof rafters 18 abut and are secured to ridge board 16 by nailing or suitable means as is well known by those of ordinary skill in the art and define the angle of the roof 20. Decking or sheathing 22 is secured to rafters 18 by suitable means as nailing. Each side 24 of roof 20 is covered by a plurality of roofing tiles 26 laid in overlapping rows or courses 28 and secured to decking or sheathing 22 by suitable means such as nailing. Although roofing tiles 26 are shown as being semicircular in cross section, tiles 26 could be flat and work equally well. Ridge row cap tiles 30 are secured to ridge row header 12 by suitable means as nailing.

Figure 7:
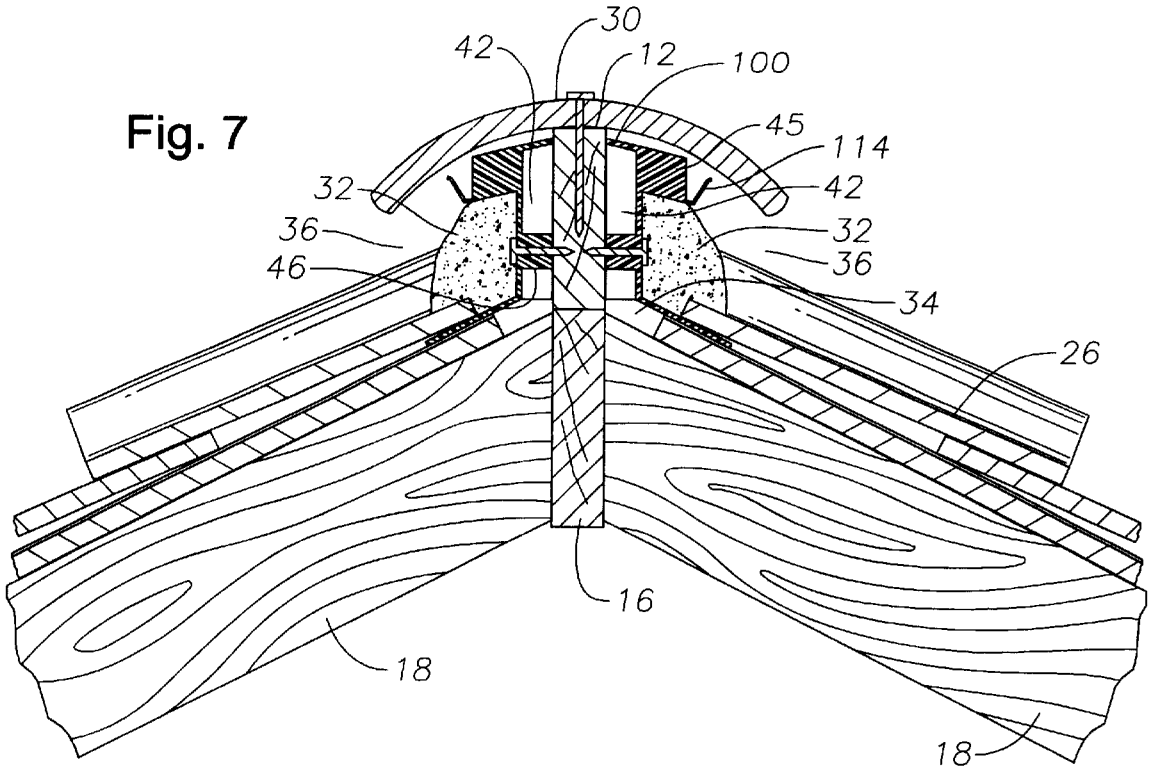
FIG. 7 is a section view of the tile roof ridge vent of FIG. 6, taken along lines 7—7.

As best seen in FIG. 7, the upper end of roofing tiles 26 are sealed to high wind area ridge row vents 100 by mortar 32. Decking or sheathing 22 terminates a short distance, typically ¾" to 1", from ridge row header 12 and ridge board 16 to form ventilation slot 34. Hot air within the attic space below roof 20 can then flow upward through ventilation slots 34 and out through high wind area ridge row vents 100.

The height of ridge row header 12 and the size of ridge row cap tiles 30 are chosen so that air gap 36 is left to allow the aforementioned hot air to vent to the outside air.

Figure 8:
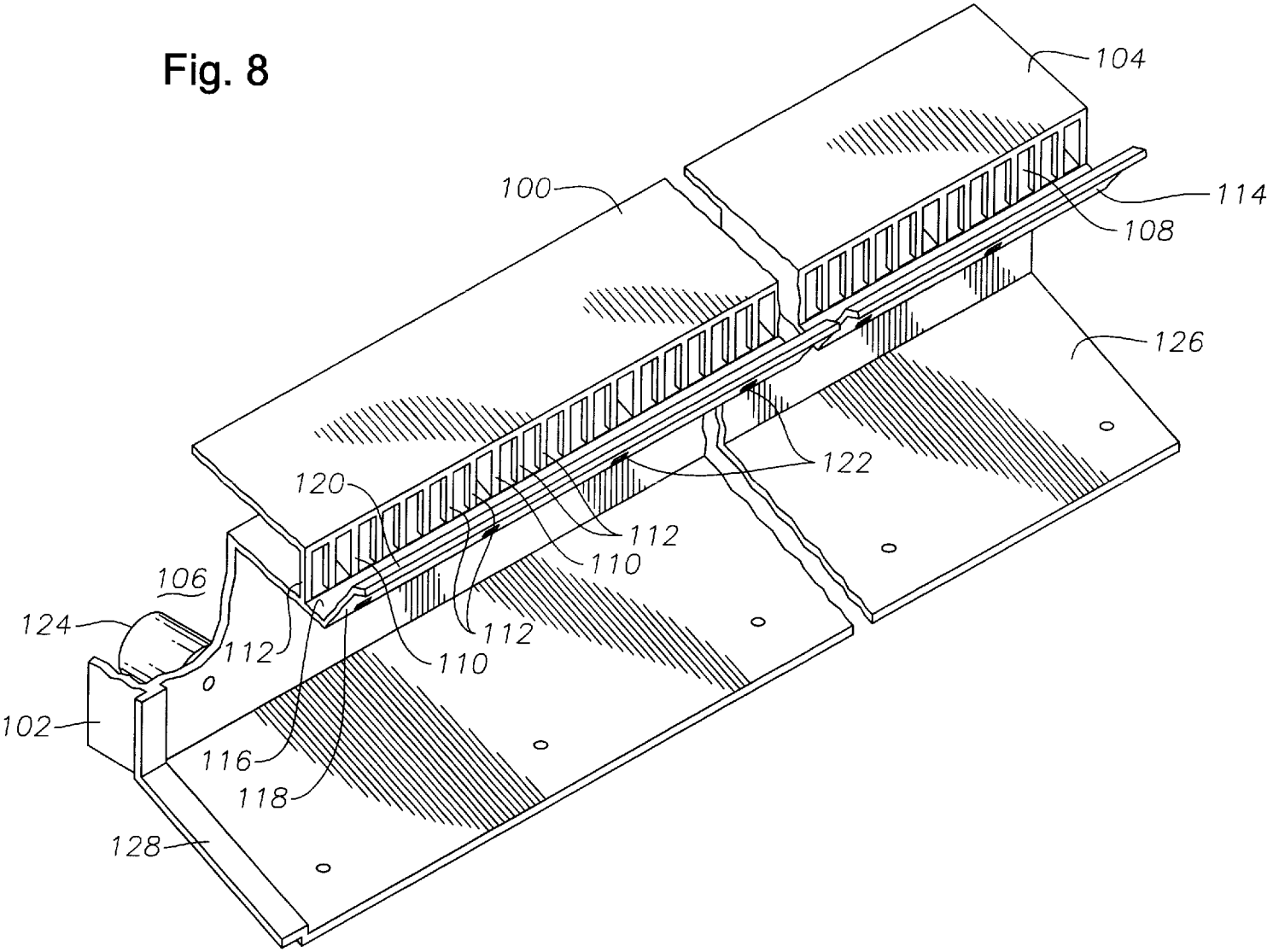
FIG. 8 is a perspective view of the tile roof ridge vent, partly in section.

Details of high wind area ridge row vent 100 are best seen in FIG. 8. High wind area ridge row vent 100 is composed of vertical section 102 and side section 104 molded as a unitary structure of a suitable thermal set plastic. Vertical section 102 and side section 104 are connected by air channel 106 that allows the free flow of air upwardly and outwardly through ventilation openings 108. Side section 104 with ventilation openings 108 is angled downwardly to minimize the ingress of weather elements such as blowing rain or snow. Primary baffle supports 110 are positioned periodically within ventilation openings 108. Positioned between primary baffle supports 110 are secondary baffles 112. Secondary baffles 112 help to prevent the ingress of inclement weather, such as blowing rain or snow.

High wind area ridge row vents 100 also include external baffle 114 positioned adjacent ventilation openings 108. External baffle 114 is molded integrally as part of high wind area ridge row vent 100. External baffle 114 includes bottom channel 116, side lip 118 and upper lip 120. Side lip 118 and upper lip 120 are angled upwardly and outwardly from channel 116 to direct wind and wind driven water away from secondary baffles 112. Drain slots 122 are molded into external baffle 114 at the juncture of bottom channel 116 and side lip 118 to ensure drainage of any water away from secondary baffles 112. Any inclement weather entering through secondary baffles 112, is stopped by the downward slope of ventilation openings 108 and can then run back out ventilation opening 108 and drain slots 122.

Vertical section 102 includes securing points or buttons 124 integrally formed on the rear of vertical section 102. Securing points or buttons 124 allow proper spacing of high wind area ridge row vents 100 with respect to ridge row header 12 and ensure air channel 106 is positioned over ventilation slots 34. Sealing skirt 126 is also integrally formed on the lower portion of vertical section 102. Sealing skirt 126 can be bent to accommodate varying roof angles. At one end of high wind area ridge row vents 100 and formed on sealing skirt 102 is lip seal 128. Lip seal 128 is designed to overlap sealing skirt 126 when high wind area ridge row vents 100 are laid end to end and prevent any leakage between adjacent high wind area ridge row vents 100. Sealing skirt 126 is nailed to decking or sheathing 22 underneath roofing tiles 26. As noted above, mortar 32 is applied between sealing skirt 126 and the upper end of roofing tiles 26 to ensure blowing rain or other inclement weather does not get underneath roofing tiles 26 to decking 22.

Figure 9:
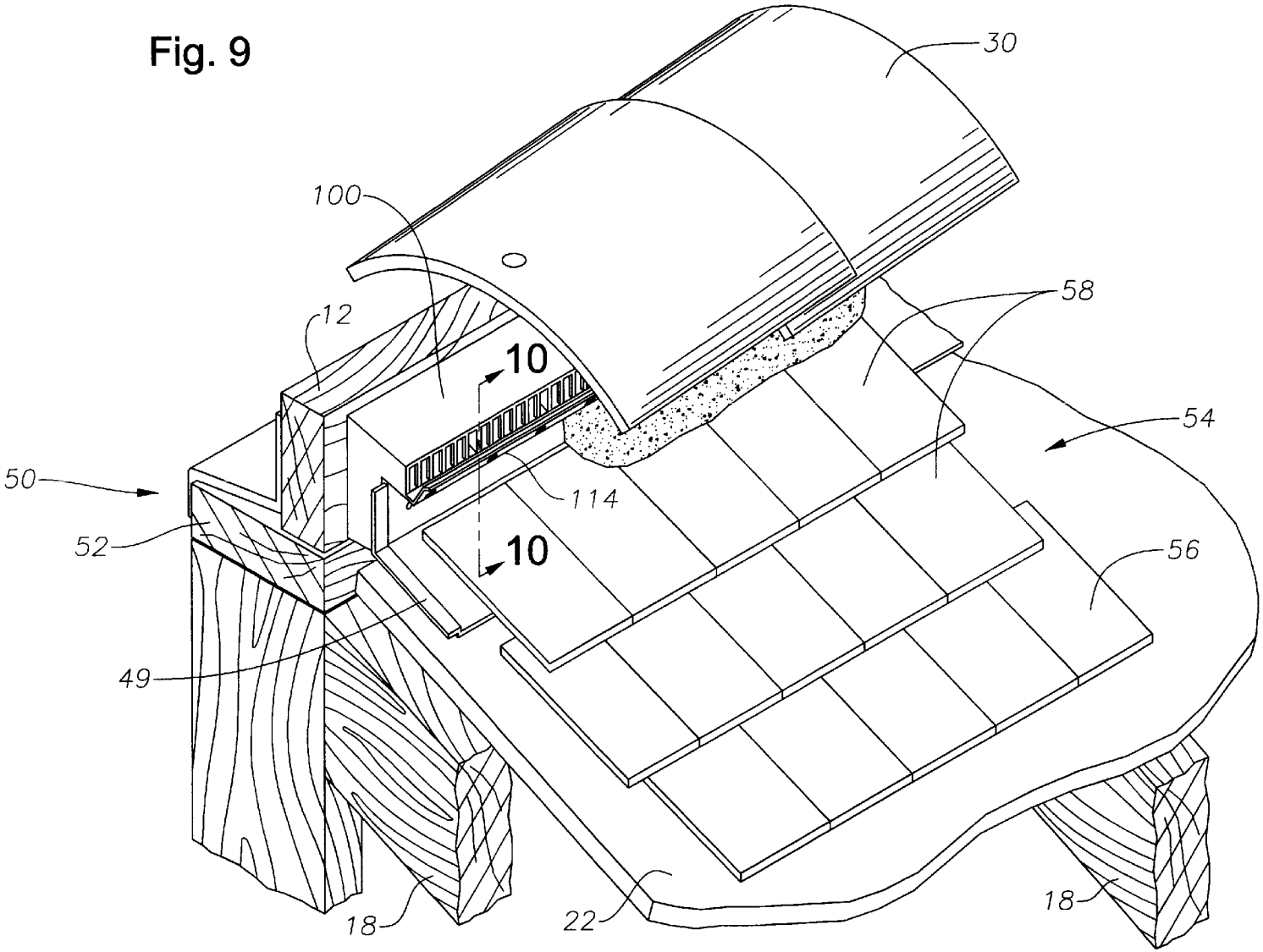
FIG. 9 is a perspective view of the tile roof ridge vent installed on a single side or mansard style roof with flat tiles.

A fourth embodiment showing high wind area ridge row vent 100 in conjunction with a single sided or mansard style roof 50 is shown in FIG. 9. Those items which are the same as in the previous embodiments retain their numerical designations. High wind area ridge row vents 100 are disposed on the side of ridge row header 12 of mansard roof 50. Ridge row header 12 sits atop header board 52. Roof rafters 18 abut and are secured to header board 52 by nailing or suitable means as is well known by those of ordinary skill in the art and define the angle of mansard roof 50. Decking or sheathing 22 is secured to rafters 18 by suitable means as nailing. Side 54 of mansard roof 50 is covered by a plurality of roofing tiles 56 laid in overlapping rows or courses 58 and secured to decking or sheathing 22 by suitable means such as nailing. Although roofing tiles 56 are shown as being flat, tiles 56 could be of a semicircular cross section and work equally well. Ridge row cap tiles 30 are secured to ridge row header 12 by suitable means as nailing.

Figure 10:
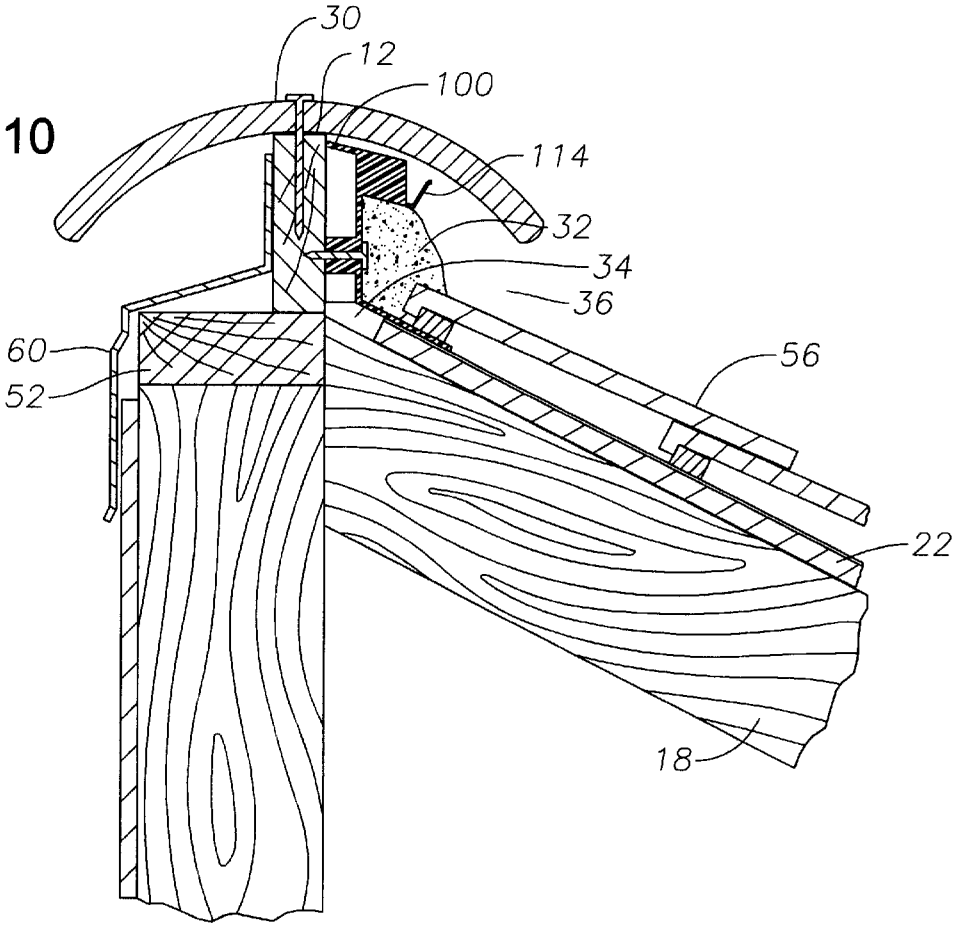
FIG. 10 is a section end view of the tile roof ridge vent of FIG. 9, taken along lines 10—10.

As best seen in FIG. 10, the upper end of roofing tiles 26 are sealed to high wind area ridge row vent 100 by mortar 32. Decking or sheathing 22 terminates a short distance, typically ¾" to 1", from ridge row header 12 and header board 52 to form ventilation slot 34. Hot air within the attic space below roof 50 can then flow upward through ventilation slot 34 and out through high wind area ridge row vents 100. The height of ridge row header 12 and the size of ridge row cap tiles 30 are chosen so that air gap 36 is left to allow the aforementioned hot air to vent to the outside air. The opposite side of roof 50 is closed off by suitable sealing means as flashing 60, well known to those of ordinary skill in the art.

The novel method of use and construction of my tile roof ridge row vent will be readily understood from the foregoing description and it will be seen that I have provided a novel ridge row vent for use with tile roofs of various types. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A tile roof ventilation system to ventilate the interior space under the roof to the exterior, comprising:

a first plurality of roofing tiles arranged in overlapping courses located on at least one side of an angled roof;

a second plurality of roofing tiles arranged in overlapping courses located on an adjacent side of an angled roof;

a ridge row header disposed between said first plurality of roofing tiles and said second plurality of roofing tiles, said ridge row header extending above said roof tiles to allow securing a ridge row vent thereto;

first and second ventilation slots adjacent said ridge row header;

first and second ridge row vents disposed on either side of said ridge row header, said first and said second ridge row vents disposed over said first and said second ventilation slots to facilitate air flow from the interior space under the roof to the exterior;

a plurality of ridge row cap tiles secured to said ridge row header to prevent ingress of weather elements;

a sealing mortar applied between said first and said second ridge row vents and said first and said second plurality of roofing tiles;

each of said first and second ridge row vent includes an elongate member having a vertical section and a side section, said vertical section and said side section connected to allow air flow therebetween, said vertical section having a lower sealing skirt extending under said roofing tiles, said side section including a plurality of ventilation openings, and;

said vertical section of said elongate member includes securing buttons for securing said ridge row vent to said adjacent ridge row header and spacing said ridge row vent from said adjacent ridge row header.

2. A tile roof ventilation system to ventilate the interior space under the roof to the exterior, according to claim 1, wherein:

said plurality of ventilation openings are oriented to minimize the ingress of weather elements.

3. A tile roof ventilation system to ventilate the interior space under the roof to the exterior, according to claim 2, wherein:

said vertical section of said elongate member includes a channel allowing air flow from the interior space under the tile roof adjacent said ridge row vent to said ventilation openings of said side section.

4. A tile roof ventilation system to ventilate the interior space under the roof to the exterior, according to claim 3, wherein:

said lower sealing skirt of said vertical section adapted to receive said sealing mortar for sealing said sealing skirt to adjacent roofing tiles;

said lower sealing skirt adjustable to accommodate different roof angles, and;

a lip seal is integrally formed on said lower sealing skirt on one end of said ridge row vent to overlap and seal against the lower sealing skirt of an adjacent ridge row vent.

5. A tile roof ventilation system to ventilate the interior space under the roof to the exterior, according to claim 4, wherein:

said ventilation openings includes a plurality of secondary baffles; and, said secondary baffles oriented to minimize the ingress of weather elements.

6. A tile roof ventilation system to ventilate the interior space under the roof to the exterior, according to claim 5, wherein:

said side section further includes an external baffle positioned adjacent said ventilation openings; and, said external baffle is oriented to minimize the ingress of weather elements.

7. A tile roof ventilation system to ventilate the interior space under the roof to the exterior, according to claim 6, wherein:

said external baffle includes a plurality of drain slots.

8. A tile roof ventilation system to ventilate the interior space under the roof to the exterior, comprising:

a first plurality of roofing tiles arranged in overlapping courses located on at least one side of an angled roof;

a ridge row header disposed adjacent said first plurality of roofing tiles, said ridge row header extending above said first plurality of roofing tiles to allow securing a ridge row vent thereto;

a ventilation slot adjacent said ridge row header;

a ridge row vent disposed adjacent said ridge row header, said ridge row vent disposed over said ventilation slot to facilitate air flow from the interior space under the roof to the exterior;

a plurality of ridge row cap tiles secured to said ridge row header to prevent ingress of weather elements;

a sealing mortar applied between said ridge row vent and said first plurality of roofing tiles;

said ridge row vent includes an elongate member having a vertical section and a side section, said vertical section and said side section connected to allow air flow therebetween, said vertical section having a lower sealing skirt extending under said roofing tiles, said side section including a plurality of ventilation openings, and;

said vertical section of said elongate member includes securing buttons for securing said ridge row vent to said adjacent ridge row header and spacing said ridge row vent from said adjacent ridge row header.

9. A tile roof ventilation system to ventilate the interior space under the roof to the exterior, according to claim 8, wherein:

said plurality of ventilation openings are oriented to minimize the ingress of weather elements.

10. A tile roof ventilation system to ventilate the interior space under the roof to the exterior, according to claim 9, wherein:

said vertical section of said elongate includes a channel allowing air flow from the interior space under the tile roof adjacent said ridge row vent to said ventilation openings of said side section.

11. A tile roof ventilation system to ventilate the interior space under the roof to the exterior, according to claim 10, wherein:

said lower sealing skirt of said vertical section adapted to receive said sealing mortar for sealing said sealing skirt to adjacent roofing tiles;

said lower sealing skirt adjustable to accommodate different roof angles, and;

a lip seal is integrally formed on said lower sealing skirt on one end of said ridge row vent to overlap and seal against the lower sealing skirt of an adjacent ridge row vent.

12. A tile roof ventilation system to ventilate the interior space under the roof to the exterior, according to claim 11, wherein:

said ventilation openings includes a plurality of secondary baffles; and, said plurality of secondary baffles oriented to minimize the ingress of weather elements.

13. A tile roof ventilation system to ventilate the interior space under the roof to the exterior, according to claim 12, wherein:

said side section further includes an external baffle positioned adjacent said ventilation openings; and, said external baffle oriented to minimize the ingress of weather elements.

14. A tile roof ventilation system to ventilate the interior space under the roof to the exterior, according to claim 13, wherein:

said external baffle includes a plurality of drain slots.

15. A ventilation apparatus for a tile root comprising:

an elongate member having a vertical section and a side section;

said vertical section and said side section connected to allow air flow therebetween;

said vertical section having a lower sealing skirt for extending under a plurality of roofing tiles;

said side section including a plurality of ventilation openings, and;

said vertical section of said elongate member includes securing buttons for Securing a ridge row vent to an adjacent ridge mw header and spacing said ridge row vent from said adjacent ridge row header.

16. A ventilation apparatus for a tile roof, according to claim 15, wherein:

said plurality of ventilation openings are oriented to minimize the ingress of weather elements.

17. A ventilation apparatus for a tile roof, according to claim 16, wherein:

said vertical section of said elongate member includes a channel allowing air flow from the interior space under the tile roof adjacent said ventilation apparatus to said ventilation openings of said side section.

18. A ventilation apparatus for a tile roof, according to claim 17, wherein:

said lower sealing skirt of said vertical section adapted to receive a sealing mortar for sealing said sealing skirt to adjacent roofing tiles;

said lower sealing skirt adjustable to accommodate different roof angles, and;

a lip seal is integrally formed on said lower sealing skirt on one end of said ridge row vent to overlap and seal against the lower sealing skirt of an adjacent ridge row vent.

19. A tile roof ventilation system to ventilate the interior space under the roof to the exterior, according to claim 18, wherein:

said side section further includes an external baffle positioned adjacent said ventilation openings; and, said external baffle oriented to minimize the ingress of weather elements.

20. A tile roof ventilation system to ventilate the interior space under the roof to the exterior, according to claim 19, wherein:

said external baffle includes a plurality of drain slots.

* * * * *